US005709051A

United States Patent [19]

Mazziotti

[11] Patent Number: 5,709,051

[45] Date of Patent: Jan. 20, 1998

[54] DEBRIS REMOVAL DEVICE FOR RAIN GUTTER DOWNSPOUTS

[76] Inventor: Robert R. Mazziotti, 30470 Seely La., Eugene, Oreg. 97405

[21] Appl. No.: 758,186

[22] Filed: Nov. 25, 1996

[51] Int. Cl.[6] ..... E04D 13/076

[52] U.S. Cl. ..... 52/12; 52/16; 210/162; 210/446; 210/451

[58] Field of Search ..... 52/11, 12, 16; 210/162, 446, 451, 474, 477

[56] References Cited

U.S. PATENT DOCUMENTS

| | | | |
|---|---|---|---|
| 1,177,174 | 3/1916 | Doty . | |
| 1,552,902 | 9/1925 | Werner | 210/130 |
| 2,090,997 | 8/1937 | French | 210/433.1 |
| 2,288,121 | 6/1942 | Cisar et al. | 52/12 |
| 2,419,501 | 4/1947 | Pinto . | |
| 2,494,780 | 1/1950 | Schmidt . | |
| 2,746,297 | 5/1956 | Martin | 210/477 X |
| 2,887,073 | 5/1959 | Thompson | 52/16 |
| 3,426,866 | 2/1969 | Jensen | 210/446 X |
| 3,628,668 | 12/1971 | Huppert | 210/446 |
| 4,523,875 | 6/1985 | DiFiore | 52/12 X |
| 4,615,153 | 10/1986 | Carey . | |
| 4,798,025 | 1/1989 | Pinion | 52/16 |
| 4,801,377 | 1/1989 | Bolt . | |
| 4,905,427 | 3/1990 | McPhalen | 52/12 |
| 5,230,798 | 7/1993 | Rogman . | |
| 5,526,612 | 6/1996 | Wade | 52/12 |

FOREIGN PATENT DOCUMENTS

| | | | |
|---|---|---|---|
| 2055148 | 5/1971 | Germany | 52/16 |
| 3139304 | 4/1983 | Germany | 52/16 |
| 4321408 | 1/1995 | Germany | 52/16 |
| 673867 | 4/1990 | Switzerland | 52/16 |
| 2132657 | 7/1984 | United Kingdom | 52/12 |

*Primary Examiner*—Wynn E. Wood
*Assistant Examiner*—Laura A. Callo
*Attorney, Agent, or Firm*—Chernoff, Vilhauer, McClung & Stenzel

[57] ABSTRACT

A debris removal device for rain gutter downspouts is inserted between the bottom of the downspout and the top of a ground drainpipe into which the downspout empties. The device comprises an elongate tubular housing open on both ends and having an unobstructed third opening formed transversely through the tubular wall between the ends. A partition, having apertures formed therein, extends generally transversely within the tubular housing at an inclination converging toward the third opening so as to divert debris, which enters the tubular housing through the first opening, out the third opening while enabling rainwater associated with the debris to pass through the apertures in the partition and out the second opening. Water flow guides associated with the partition divert rainwater away from the third opening to inhibit it from flowing out the third opening along with the debris. A dam is provided at the bottom of the third opening to likewise inhibit the flow of water out the third opening.

4 Claims, 2 Drawing Sheets

DEBRIS REMOVAL DEVICE FOR RAIN GUTTER DOWNSPOUTS

BACKGROUND OF THE INVENTION

The present invention relates to improvements in debris removal devices for rain gutter downspouts to inhibit obstruction of such downspouts.

Previous devices have been known for removing debris, such as leaves, evergreen needles and twigs, from rain gutter downspouts. Exemplary prior devices of this type are shown in U.S. Pat. Nos. 1,177,174, 2,419,501, 2,494,780, 4,615,153, 4,801,377, and 5,230,798. Some such devices utilize debris traps, but such enclosed traps are not self-cleaning and therefore will quickly become obstructed if not cleaned regularly. On the other hand, those devices that are self-cleaning tend to divert too much water out of the downspout along with the debris. If their debris discharge openings are obstructed with a door or other impediment, the diversion of water is reduced, but clogging of the device becomes more likely.

Previous self-cleaning debris removal devices have typically been positioned in gutter downspouts at a relatively high elevation adjacent to the sidewall of a building, because of the belief that the downspout will be too susceptible to clogging in the region above the debris removal device if such region is too lengthy. However, such an elevated position adjacent to the wall of the building inevitably results in some of the debris contacting the side of the building and clinging thereto as it descends to the ground, creating an unsightly strip of debris extending vertically along the side of the building.

BRIEF SUMMARY OF THE INVENTION

The present invention overcomes the foregoing drawbacks of prior downspout debris removal devices by providing an improved self-cleaning device which more effectively separates the debris from the rainwater. The device includes an elongate, open-ended tubular housing having a side opening formed in the tubular wall, and an inclined, apertured partition extending within the tubular housing at an inclination converging toward the side opening to divert debris out of the opening.

According to one aspect of the invention, water flow guides associated with the partition diverge generally transversely to the inclination of the partition toward portions of the tubular wall located on opposite sides of the side opening. Such water flow guides preferably are positioned on the debris-diverting surface of the partition in substantially nonprotruding relation thereto so as to guide the water away from the side opening by adhesion to the guides while the debris, which does not have the same tendency to follow the flow guides by adhesion, moves freely out of the side opening.

According to another aspect of the invention, the partition has an inclined portion nearest to the side opening which converges toward a position on the tubular wall which is offset below the side opening so as to form a dam between the partition and the side opening, thereby further inhibiting the flow of water out of the side opening.

According to a further aspect of the invention the debris removal device is preferably not positioned in the gutter downspout at a high elevation, due to the inventor's recognition that most clogging of downspouts occurs not in the downspout itself but rather as a result of clogging of the cylindrical ground drainpipe into which the downspout empties. Therefore, the device of the present invention is preferably equipped with a generally rectangular opening at one end which matingly receives a bottom portion of a rectangular gutter downspout, and a generally cylindrical opening at the other end which is inserted matingly into a top portion of a cylindrical ground drainpipe. The resultant low elevation of the device enables the side opening through which the debris is discharged to be substantially unobstructed to maximize free flow of the debris without thereby causing the debris to cling to the sidewall of the building in an unsightly manner.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
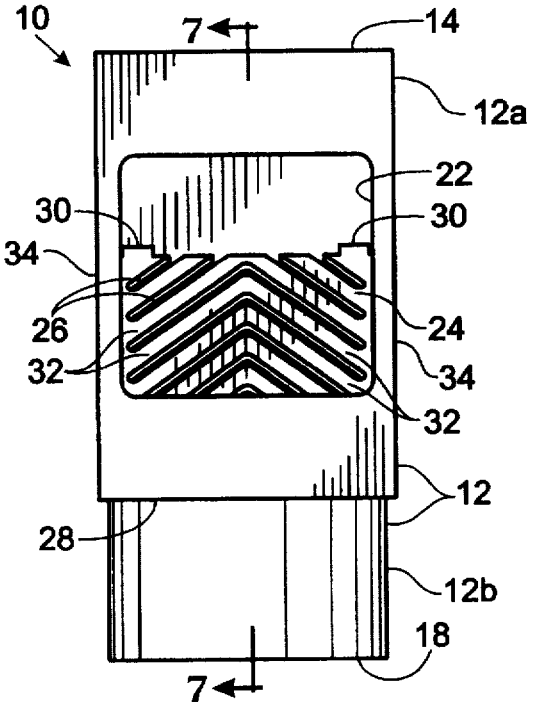
FIG. 1 is a front view of an exemplary embodiment of a debris removal device in accordance with the present invention.
Figure 2:
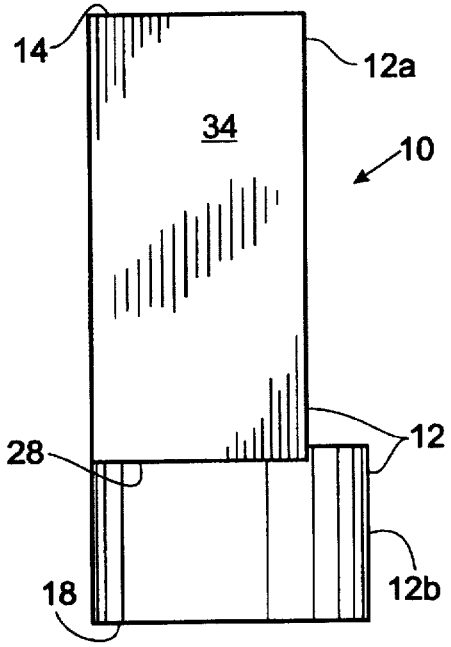
FIG. 2 is a side view of the device of FIG. 1.
Figure 3:
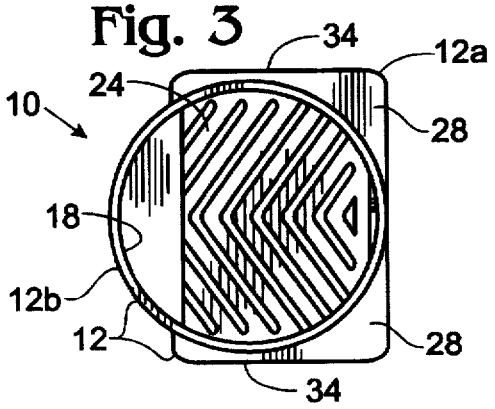
FIG. 3 is a bottom view of the device FIG. 1.
Figure 4:
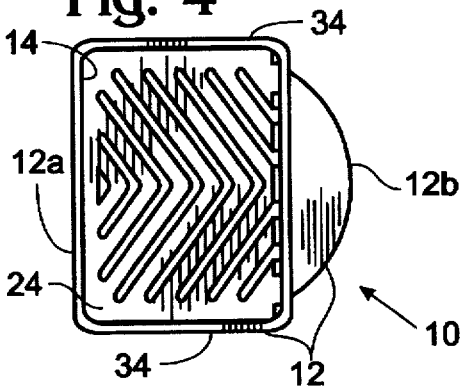
FIG. 4 is a top view of the device of FIG. 1.
Figure 5:
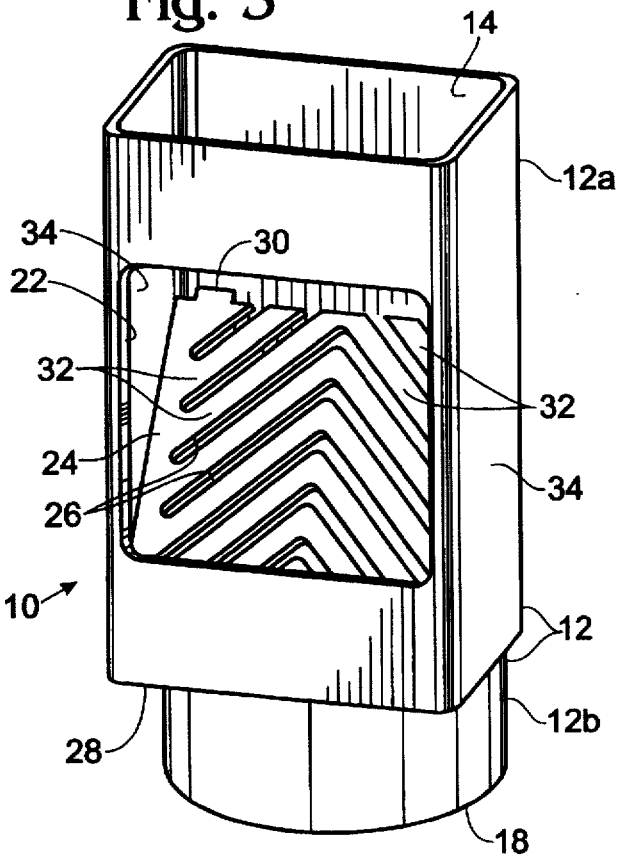
FIG. 5 is a perspective view of the device of FIG. 1.

An exemplary embodiment of a debris removal device in accordance with the present invention is indicated generally as 10. It comprises an elongate generally tubular housing 12 having a first end with a generally rectangular opening 14 therein for matingly receiving a rectangular gutter downspout 16, and a second end having a generally cylindrical opening 18 therein for mating insertion into a cylindrical ground drainpipe 20. The device is preferably fabricated from a suitable moldable plastic, but could alternatively be of rust-resistant metal. The housing 12 is preferably of one-piece construction with a rectangular section **12*a* and cylindrical section 12*b***, although a multipiece construction could alternatively be used.

Passing transversely through the tubular wall of the housing 12 is a third opening 22. A partition 24 having apertures 26 formed therein extends transversely within the housing 12 at an inclination converging toward the opening 22. The partition 24 is supported removably within the housing by the bottom margin 28 of the rectangular section of the housing in the area beneath the opening 22 and by snap-in tabs 30 inserted into mating apertures in the opposite side of the tubular wall of the housing.

Between the apertures 26 in the partition 24, elongate water flow guides 32 are formed in a pattern diverging from each other transversely to the inclination of the partition 24 toward the portions 34 of the tubular wall located on opposite sides of the opening 22. Such water flow guides 32 preferably do not protrude upwardly from the surface of the partition 24 so that they will not mechanically impede debris sliding down the partition toward the opening 22.

Figure 7:
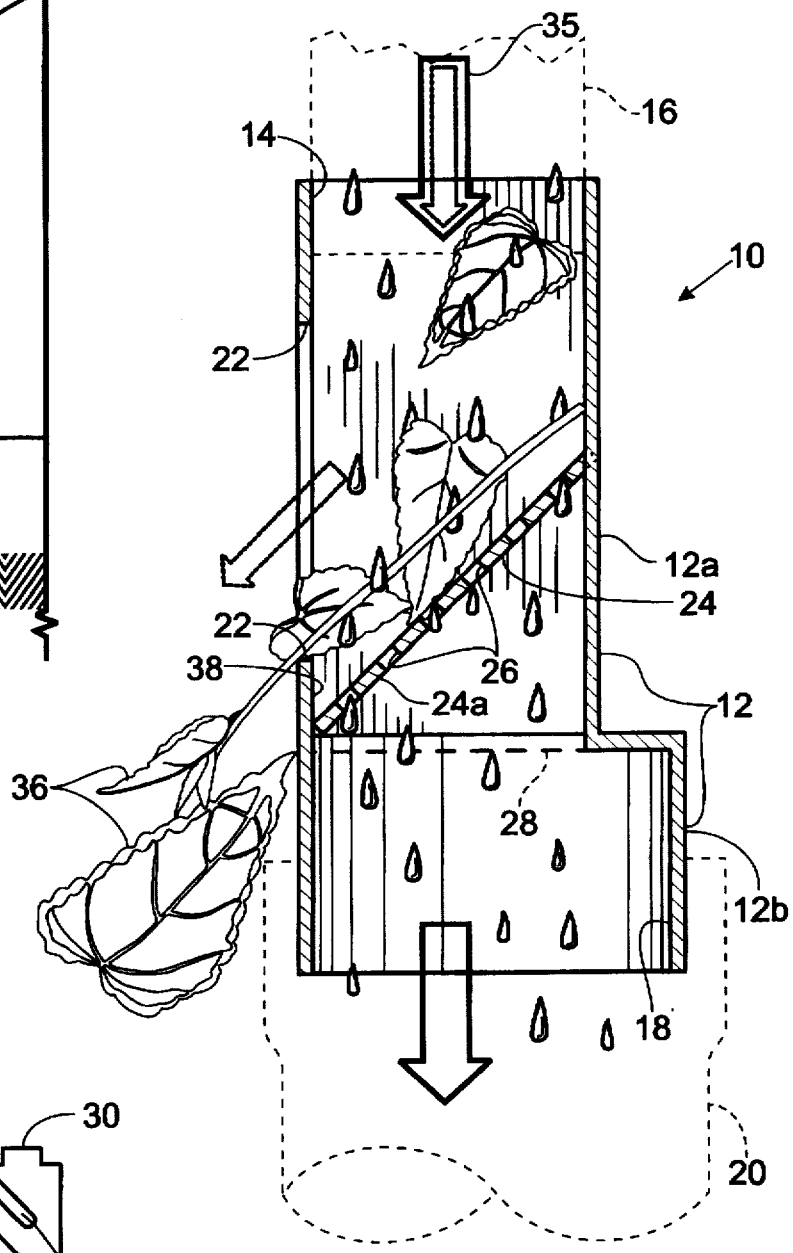
FIG. 7 is a sectional view taken along line 7—7 of FIG. 1, with the rectangular gutter downspout and cylindrical ground drainpipe shown in phantom.
Figure 6:
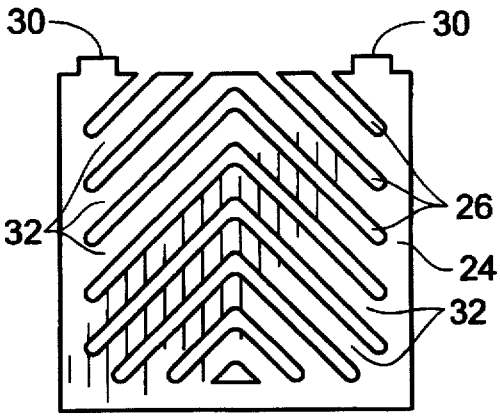
FIG. 6 is a top detail view of the partition within the device of FIG. 1.

With reference to FIG. 7, the combination of debris and water entering the housing 12 from the downspout 16, as indicated by the arrow 35, contacts the partition 24 diverting the debris, such as leaves 36, slidably out the opening 22. If the partition 24 were merely an ordinary screen or grate having uniformly distributed apertures therein, the debris 36 which is concentrated near the center of the partition would likewise divert much of the water out the opening 22 together with the debris. However, the diverging water flow guides 32 tend to divert the water by adhesion away from the center of the partition 24 and toward the opposite side portions 34 of the tubular wall, enabling the water more readily to fall through the apertures 26 near the sides of the partition and out the opening 18 in the housing 12 into the cylindrical ground drainpipe 20. The diverging water guides 32 thus provide more effective separation of the water from the debris.

As seen in FIG. 7, the inclined portion 24*a* of the partition 24 which is nearest to the opening 22 converges toward a position on the tubular wall which is offset from the opening 22 in a direction toward the opening 18. This arrangement forms a dam 38 between the partition 24 and the opening 22 which further discourages water from flowing out the opening 22 and instead encourages the water to flow through the apertures 26 in the partition, thereby further enhancing the separation of the water from the debris.

Figure 8:
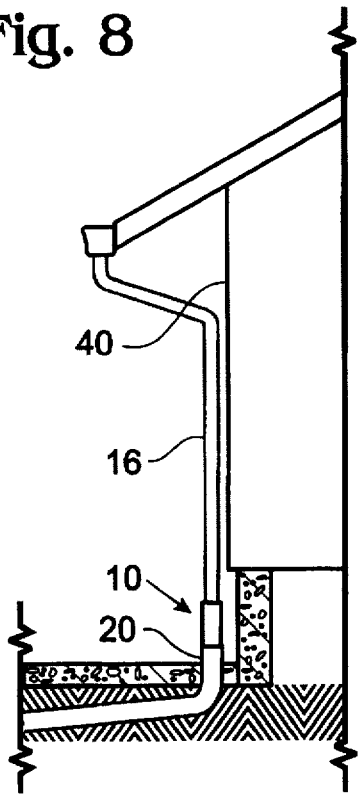
FIG. 8 is an assembly drawing showing the device of FIG. 1 in a typical installation.

As shown in FIG. 8, the device 10 is installed at a low elevation between the bottom of the downspout 16 and the top of the cylindrical ground drainpipe 20. Preferably, the device 10 is installed at or below the bottom of the sidewall 40 of the building, but still sufficiently above ground level that the debris 36 discharged from the opening 22 falls a significant distance from the opening to the ground and therefore does not accumulate in front of the opening. With such an arrangement, none of the debris has an opportunity to cling to the sidewall 40 of the building in an unsightly manner.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A debris removal device for rain gutter downspouts, said device comprising:

(a) an elongate substantially tubular housing having a first end and a second end with a substantially tubular wall therebetween;

(b) a first opening formed in said first end, a second opening formed in said second end, and a third opening formed in said tubular wall between said first end and said second end;

(c) a partition, having apertures formed therein, extending generally transversely within said tubular housing in a direction of inclination extending toward said second end and away from said first end and converging toward said third opening so as to divert debris, entering said tubular housing through said first opening, out said third opening while enabling rainwater associated with said debris to pass through said apertures and out said second opening; and (d) said partition having elongate water flow guides which diverge in said direction of inclination transversely toward portions of said tubular wall located on opposite sides of said third opening.

2. The device of claim 1 wherein said partition has a surface facing said first opening, and said water flow guides comprise elongate diverging members located on said surface in substantially nonprotruding relation to said surface.

3. The device of claim 1 wherein said partition has an inclined portion nearest to said third opening which converges toward a position on said tubular wall offset from said third opening in a direction toward said second opening, so as to form a dam between said partition and said third opening.

4. The device of claim 1 wherein said first opening is generally rectangular in shape for matingly receiving a bottom portion of a rectangular gutter downspout, and said second opening is generally cylindrical in shape for mating insertion into a top portion of a cylindrical ground drainpipe.

* * * * *